United States Patent [19]

Cinotti

[11] Patent Number: 4,861,227

[45] Date of Patent: Aug. 29, 1989

[54] APPARATUS FOR THE AUTOMATIC SEPARATION OF STACKED SHEETS OF LARGE FORMAT PAPER INTO REAMS, AND FOR SUBSEQUENT TRANSFER OF THE REAMS TO WRAPPING MACHINERY

[75] Inventor: Andrea Cinotti, Bologna, Italy

[73] Assignee: Wrapmatic S.p.A., Bologna, Italy

[21] Appl. No.: 121,233

[22] Filed: Nov. 16, 1987

[30] Foreign Application Priority Data

Dec. 16, 1986 [IT] Italy ..... 3608 A/86

[51] Int. Cl.[4] ..... B65H 3/32

[52] U.S. Cl. ..... 414/796.8; 414/796; 414/907

[58] Field of Search ..... 414/46, 114, 118, 117, 414/119, 907, 796, 796.6, 796.7, 796.8

[56] References Cited

U.S. PATENT DOCUMENTS

| | | | |
|---|---|---|---|
| 3,174,633 | 3/1965 | Stevens | 414/119 X |
| 3,176,859 | 4/1965 | Prager | 414/119 X |
| 4,506,874 | 3/1985 | Preisig | 414/907 X |
| 4,551,053 | 11/1985 | Ishibashi | 414/907 X |
| 4,620,827 | 11/1986 | Sameshima et al. | 414/119 X |
| 4,623,292 | 11/1986 | Suzuki et al. | 414/119 X |

*Primary Examiner*—Robert J. Spar
*Assistant Examiner*—Janice Krizek
*Attorney, Agent, or Firm*—Laff, Whitesel, Conte & Saret

[57] ABSTRACT

The apparatus includes a suspended locating element against which the stack of sheets is urged and compacted, and a separator mechanism, set apart from the locating element at a distance matching the depth of a compacted ream, the sharp edge of which approaches and penetrates the stack; the separator mechanism is mounted by way of a damper to a drive system that traverses the entire assembly toward the infeed station of the wrapping machine while the remainder of the stack is held and compacted by a separately anchored mechanism to avoid the topmost sheets being dragged along with the separated ream.

2 Claims, 2 Drawing Sheets

APPARATUS FOR THE AUTOMATIC SEPARATION OF STACKED SHEETS OF LARGE FORMAT PAPER INTO REAMS, AND FOR SUBSEQUENT TRANSFER OF THE REAMS TO WRAPPING MACHINERY

BACKGROUND OF THE INVENTION

The invention disclosed relates to an apparatus for the automatic separation of stacked sheets of large format paper into reams, and for subsequent transfer of the reams to wrapping machinery.

In the art field embracing the manufacture of paper in reams of large format sheets for designers, artists etc., a problem typically encountered with the wrapping operation is that of how the reams are fed to the wrapping machine.

Reams destined for wrapping by the machine are discharged by the sheeter onto a pallet in a simple stack of single sheets; the pallet is placed on an elevator platform which ascends automatically every time the operator removes a ream, in such way that handling occurs at an unvarying height.

Substantially two basic conventional methods are used for separating the stack of sheets into reams.

The first such method is extremely precise. The stack of sheets from which the reams are formed is prepared by a machine that counts off the sheets and inserts a marker between one sheet and the next each time the count is completed; the marker is nothing other than a piece of paper or some other material, colored or otherwise, that protrudes from the stack, and the operator simply lifts off the stacked sheets that lie above the marker and supplies them to the wrapping machine.

The second method makes use of an instrument similar to a gage, with two measuring arms, one of which is fixed and provided with a locator, the other mobile and fitted with a blade designed to penetrate between adjacent sheets. The operator calculates the depth of the ream on the basis of the number and the thickness of the single sheets, then, offering the fixed locating arm to the top sheet, slides the gage forward to the point where the blade inserts between two sheets at the selected depth, and thus separates the ream from the remainder of the stack beneath.

This second method is basically sound, but tends to be insufficiently accurate as a result of being dependent on a number of factors, e.g. the moisture content and the thickness of the sheets.

Thin sheets ensure greater precision, since the blade of the instrument can slip more easily between them; on the other hand, the blade can dig into the edge of a thicker product, such as cartridge paper.

An additional factor tending to compromise the accuracy of this second method is the height of the stack of sheets; more exactly, the topmost ream to be separated will be of a certain depth, but this depth will reduce as the stack gradually diminishes, by dint of the fact that the sheets lower down are compressed and compacted permanently by the weight of the sheets above.

At all events, separation of the stack of sheets into reams, in either of the methods thus described, remains a manually-implemented process.

Accordingly, the object of the invention is to provide an apparatus capable of receiving a stack of sheets and separating it into reams automatically, then of supplying the reams to the infeed station of a wrapping machine, likewise automatically.

A further object of the invention is to embody an apparatus that will be capable of achieving this main object in an economical and functional manner.

SUMMARY OF THE INVENTION

The stated object is achieved with an apparatus as described and claimed herein, which is provided with compacting means that compress the stack to an exact and unvarying degree, and with at least one separator mechanism that is adjustable for position in relation to the compacting means and capable of movement between a retracted position, distanced from the stack of sheets, and at least one extended position in which its tapered probing end penetrates into the stack of sheets in preparation for transfer of the separated ream toward the infeed station of the wrapping machine.

One advantage of the invention is the facility is affords of feeding large size reams automatically into a wrapping machine; separation of single reams from the bulk supply is effected with due precision thanks to the inclusion of the compacting means, which permit of compressing the stack to a degree such as eliminates the height-weight factor tending to produce an uneven unit thickness of the sheets.

A further advantage of the apparatus disclosed is that of its simple constructional embodiment, a factor bringing singular benefits in terms of cost and practical application.

BRIEF DESCRIPTION OF THE DRAWINGS

The invention will now be described in detail, by way of example, with the aid of the accompanying drawings, in which.

DESCRIPTION OF THE PREFERRED EMBODIMENT

Figure 1:
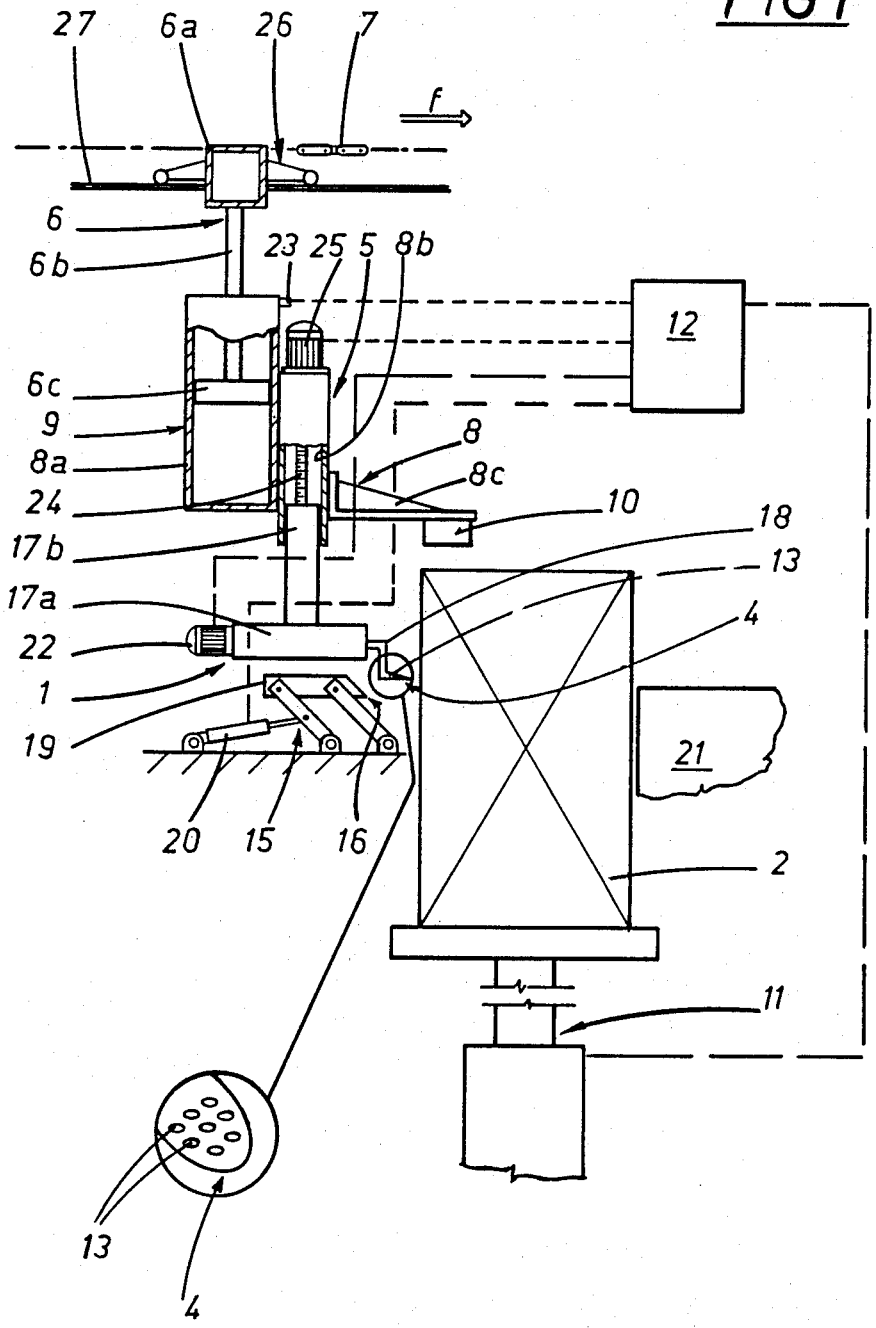
FIG. 1 is a schematic representation of the apparatus disclosed, viewed in side elevation with certain parts cut away to reveal others, illustrated in the configuration immediately preceding its work cycles.

With reference to the drawings, the apparatus as disclosed comprises:

at least one separator mechanism, denoted 1;

compacting means, denoted 10;

monitoring and control means, denoted 12.

The separator mechanism 1 consists essentially in a separator 18 and a pendant support 17, attached to a main support 5.

In the apparatus described and illustrated, the separator 18 is embodied substantially as a probe directed at the stack of sheets 2 to be divided into reams. 11 denotes elevator means by which the stack is supported. The end of the separator 18 directed at the stack 2 is substantially Z-shaped, and tapers down to a sharp edge 4 at its farthest extremity to permit of penetrating between the single sheets of the stack 2 with relative ease. 13 denotes a set of holes located near the sharp edge 4 of the separator 18, which are connected with a supply of compressed air and directed forward at the stack of sheets 2.

The separator 18 is slidable internally of, and as one with, the pendant 17 by which it is carried, between a retracted position (see FIGS. 1 and 2), in which it is distanced from the stack of sheets 2, and at least one extended position, in which its sharp edge 4 penetrates the stack 2. Movement of the separator 18 is produced by drive means 22 which are mounted to the pendant 17 and operated by monitoring and control means denoted 12, and might be embodied, say, as a stepping motor and a rack, so as to ensure gradual shift of the separator 18.

The pendant 17 appears as an upturned-T, the horizontal arm 17*a* of which axially accommodates the separator 18 and supports the drive means 22, and is itself slidable in horizontal tracks.

The main support 5 is divided into a bottom part 8 and a top part 6 that are interconnected by way of a damper 9. The top part 6 of the support consists in at least one transverse horizontal rail 6*a* and at least one vertical rod 6*b* the bottom end of which is connected to a piston 6*c*. the rail 6*a* is attached to a drive system 7 that consists in a pair of chains running parallel to the direction f followed by the reams 3 through the wrapping machine, of which the infeed station 21 only is depicted in the drawings. The rail 6*a* is carried by end trucks 26 running on two horizontal and parallel tracks 27, and is thus able to travel horizontally at a fixed height. The piston 6*c* is slidably accommodated internally of a cylindrical section 8*a* of the bottom part 8 of the support 5, and it is the assembly of the cylindrical section 8*a*, piston 6*c* and rod 6*b*, that constitutes the damper 9. Also associated with the cylindrical section 8*a* are means 23 capable of transducing the degree of relative movement between the piston 6*c* and the cylindrical section 8*a* itself, and relaying the information to the monitoring and control means 12; such transducing means 23 might take the form of a pressure-sensing or distance-measuring device etc.

The bottom part 8 of the support also comprises a bore 8*b*, having a vertical axis, inside which the vertical arm 17*b* of the T-shaped pendant is slidably accommodated in the manner of a plunger. The upright arm 17*b* is carried by a vertical lead screw 24 that passes through and mates with a female thread in the arm 17*b* itself and is keyed to the shaft of a motor, denoted 25, mounted rigidly to the bottom part 8 of the support 5. In a preferred embodiment, a stepping motor 25 will be adopted in order to ensure a fine positional adjustment of the strap probing edge 4 of the separator 18, the reason for which will become clear in due course.

Compacting means 10 in the apparatus disclosed consist in a locating element, positioned uppermost in vertical alignment with the stack of sheets 2 and rigidly attached to a horizontal bracket 8*c* issuing from the bottom part 8 of the main support 5.

The apparatus also comprises retaining means 15 which consist in a horizontal member 19 that lies parallel to the separator 18 and is embodied with a tapered end 16, directed toward the stack 2. In the embodiment illustrated, the member 19 constitutes one side of an articulated parallelogram, movement of which is brought about by actuator means 20 in the shape of a fluid power cylinder. Such retaining means 15 are carried by elevator means (not shown in the drawings) that can be adjusted so as to permit of positioning the tapered end 16 of the wedge 19 substantially on the same level as the sharp edge 4 of the separator 18, when brought into contact with the stack of sheets 2.

Figure 2:
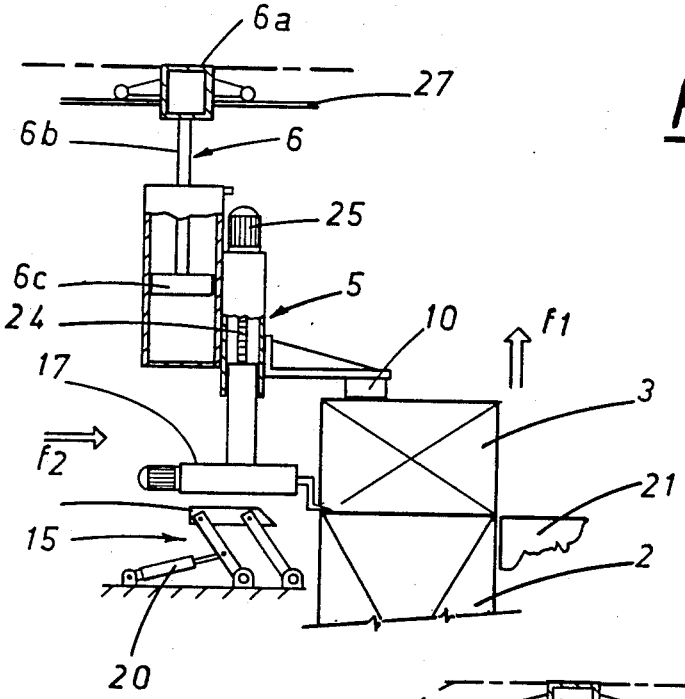
FIGS. 2, 3 and 4 are further schematic illustrations, viewed in side elevation with certain parts cut away better to reveal others, in which the apparatus is seen in various configurations during the work cycle proper.

It will be seen from FIG. 1 that the monitoring and control means 12 are connected to the elevator means 11, the fluid power cylinder 20, the drive means 22, the transducing means 23 and the pendant motor 25.

Operation of the apparatus disclosed will now be described, assuming the initial configuration to be that reached on completion of the work cycle (see FIG. 1), in which the separator mechanism 1 and the retaining means 15 are distanced from the stack of sheets 2, and the locating element 10 remains clear of the topmost sheet. A signal from the monitoring and control means 12 sets the elevator means 11 in motion to raise the stack 2 up to the point where the locating element 10 is engaged and urged upwards against the bias of the damper 9 (see arrow f1 in FIG. 2). Once the cylindrical section 8*a* has been pushed up a given distance, which registers through the transducing means 23, the elevator means 11 will be shut off at the monitoring and control means 12, signifying that compaction of the stack of sheets 2 has been effected to a degree commensurate with the shift of the cylindrical section 8*a* in relation to the piston 6*c*.

Figure 3:
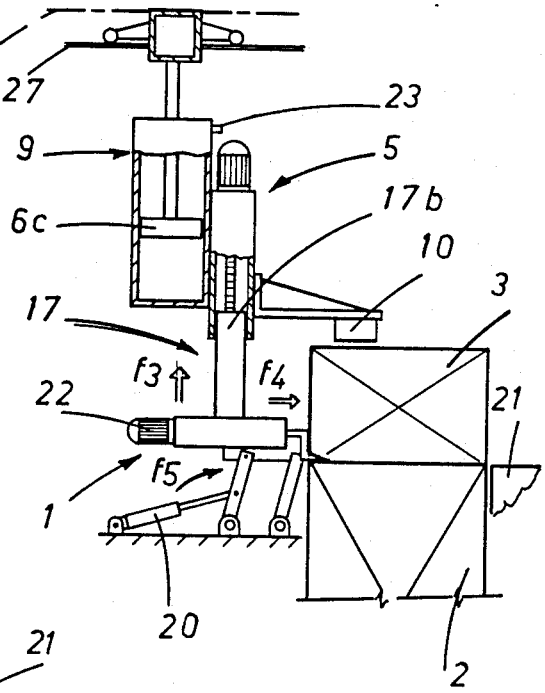

The monitoring and control means 12 now trigger start-up of the motor 25 so as to set the distance of the sharp edge 4 of the separator 18 from the locating element 10 (if not already accomplished) to match the depth of the ream 3 that must be separated from the stack of sheets 2. The drive means 22 are then started up, and the separator 18 is traversed forward (arrow f2, FIG. 2) away from the retracted position of FIG. 1 to an extended position, in which its sharp edge 4 marginally penetrates the stack of sheets 2. Compressed air is blown from the holes 13 between the two sheets parted by the edge 4 of the separator to bring about a complete break, whereupon the monitoring and control means 12 set the pendant motor 25 turning in the direction that lowers the separator mechanism 1; as the stack of sheets 2 can not be compacted further, however, and the elevator means 11 admit of no movement, the effect produced is that the bottom part 8 of the main support 5 is raised in relation to the top part 6, compressing the damper 9 (arrow f3, FIG. 3), and allowing the compacted sheets of the reams 3 encompassed by the separator 18 and the locating element 10 to spread to a given degree. The drive means 22 are now set in motion once again to send the sharp edge 4 of the separator 18 fully into the stack (arrow f4, FIG. 3), and the fluid power cylinder 20 actuated (arrow f5, FIG. 3) in such a way as to insert the wedge 19 into the stack 2 directly below the ream 3 just separated (at a transverse position other than that occupied by the edge 4), so as to re-compact the stack 2.

Figure 4:
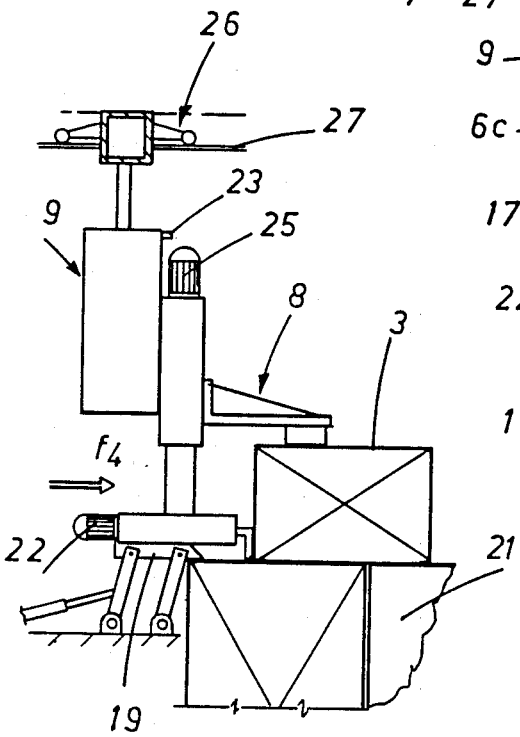

One now has operation of the drive system 7, and the entire main support 5 is traversed toward the infeed station 21 of the wrapping machine (arrow f6, FIG. 4) carrying with it the ream 3 of sheets just separated from the stack. The air holes 13 continue to operate throughout this stage in which the main support 5 moves forward; thus, an air cushion effect is created under the newly separated ream 3, easing its passage over the remainder of the pack 2 held by the retaining means 15 and avoiding damage to the topmost sheets. The work cycle terminates with the return of the support 5, the separator mechanism 1 and the retaining means 15 back to their respective at-rest positions, all retracted as in FIG. 1.

The retaining means 15 are illustrated in the drawings in a position to one side of and parallel with the separator mechanism 1, though such means 15 could equally well be located at either side of the stack of sheets, at right angles to the separator.

What is claimed:

1. An apparatus for the automatic separation of stacked sheets of large format paper into reams, and for subsequent transfer of the reams to a wrapping machinery, comprising:

means for compacting the stack of sheets, said compacting means movable vertically in relation to the stack and means to move said stack in relation to the compacting means;

at least one separator mechanism having a tapered edge directed toward the stack of sheets, said separator mechanically connected to said compacting means, and said separator being adjustable by drive means to horizontally move said separator between a retracted position distanced from the stack and at least one extended position in which the stack is penetrated at least by the tapered edge to separate the ream from the stacked sheets; and the separator mechanism and the drive means being carried by and connected through a damper to a support associated with a drive system by which the support itself is traversed horizontally so as to feed the separated ream to the wrapping machine;

the separator mechanism and the compacting means are carried by a main support having a top and a bottom part;

said top part is associated with a drive system which, when the separator mechanism occupies its extended, penetrating position, traverses the support between a retracted position, in which the ream separated in readiness for transfer remains vertically aligned with the remainder of the stacked sheets, and an extended position in which the ream is transferred to an infeeder section of the wrapping machine;

said bottom part is interconnected with the top part by way of a damper and carries the separator mechanism at its lower end;

wherein the separator mechanism is capable of moving vertically in relation to the bottom part of the main support between a raised position of initial penetration, adjustable for level to match the depth of the ream to be separated and enabling horizontal movement of the separator mechanism between the retracted position and a near extended position, and a lowered position at which full penetration and transfer are effected, which enables both horizontal movement of the separator mechanism between the near extended position and a farther extended position, and horizontal movement of the top part of the main support toward its extended position.

2. Apparatus as in claim 1, wherein the separator mechanism consists of a pendant support, attached to the bottom part of the main support and capable of vertical movement, and a separator proper, which is capable of horizontal movement in relation to the pendant between the retracted distance position and the extended penetrating position, and incorporates a tapered edge lying horizontal and parallel to the separator at a level below that of the pendant.

* * * * *